US009713930B2

(12) United States Patent
Xiu et al.

(10) Patent No.: US 9,713,930 B2
(45) Date of Patent: Jul. 25, 2017

(54) INKJET RECORDING APPARATUS

(71) Applicants: Jie Xiu, Nagoya (JP); Keisuke Wakakusa, Nagoya (JP); Iwane Sano, Obu (JP); Masao Mimoto, Nagoya (JP); Yasuhira Ota, Yatomi (JP); Shingo Ito, Kasugai (JP); Noriyuki Kawamata, Nagoya (JP)

(72) Inventors: Jie Xiu, Nagoya (JP); Keisuke Wakakusa, Nagoya (JP); Iwane Sano, Obu (JP); Masao Mimoto, Nagoya (JP); Yasuhira Ota, Yatomi (JP); Shingo Ito, Kasugai (JP); Noriyuki Kawamata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/182,100

(22) Filed: Feb. 17, 2014

(65) Prior Publication Data

US 2014/0232784 A1 Aug. 21, 2014

(30) Foreign Application Priority Data

Feb. 18, 2013 (JP) ..... 2013-028563

(51) Int. Cl.
*B41J 23/02* (2006.01)
*B41J 2/165* (2006.01)

(52) U.S. Cl.
CPC ..... *B41J 23/025* (2013.01); *B41J 2/16544* (2013.01)

(58) Field of Classification Search
CPC ..... B41J 2/16544
See application file for complete search history.

(56) References Cited

U.S. PATENT DOCUMENTS 5,168,291 A * 12/1992 Hiramatsu ..... B41J 2/17546 347/19
5,587,729 A * 12/1996 Lee ..... B41J 2/16547 347/32
2001/0055043 A1* 12/2001 Wanibuchi ..... B41J 2/16517 347/33
2007/0048058 A1 3/2007 Koga et al.
2007/0048059 A1 3/2007 Asada et al.
2007/0057447 A1 3/2007 Asada et al.
2007/0085875 A1 4/2007 Shimazaki et al.
2007/0122225 A1* 5/2007 Izuchi ..... B41J 3/60 400/624

(Continued)

FOREIGN PATENT DOCUMENTS

JP H10-337929 A 12/1998
JP 2007-090761 A 4/2007

(Continued)

OTHER PUBLICATIONS

Feb. 23, 2016—(JP) Notice of Reasons for Rejection—App 2013-028563.

*Primary Examiner* — Manish S Shah
*Assistant Examiner* — Jeffrey C Morgan
(74) *Attorney, Agent, or Firm* — Banner & Witcoff, Ltd.

(57) ABSTRACT

An inkjet recording device is described in which maintenance is performed by a maintenance unit upon a recording head. The maintenance unit is located on a base unit. The base unit includes a wall portion supporting a plurality of gear shafts protruding in a width direction from the wall portion.

27 Claims, 10 Drawing Sheets

(56) References Cited

U.S. PATENT DOCUMENTS

| | | | |
|---|---|---|---|
| 2009/0035018 | A1 | 2/2009 | Koga et al. |
| 2009/0035019 | A1 | 2/2009 | Koga et al. |

FOREIGN PATENT DOCUMENTS

| | | | |
|---|---|---|---|
| JP | 2007-090771 | A | 4/2007 |
| JP | 2008-068629 | A | 3/2008 |
| JP | 2009-034832 | A | 2/2009 |

* cited by examiner

INKJET RECORDING APPARATUS

CROSS-REFERENCE TO RELATED APPLICATION

This application claims priority from Japanese Patent Application No. 2013-028563, filed on Feb. 18, 2013, which is incorporated herein by reference in its entirety.

FIELD OF DISCLOSURE

Aspects described herein relate to an inkjet recording apparatus that ejects ink droplets from a recording head to record an image onto a recording medium.

BACKGROUND

A known ink jet recording apparatus ejects ink droplets from a plurality of nozzles defined in a recording head that is moving in a scanning direction, to record an image onto a recording medium, such as a recording sheet, being conveyed in a conveyance path.

In the known inkjet recording apparatus, rollers for conveying the recording medium are disposed at respective positions along the conveyance path. A gear train including a plurality of gears that are engaged with one another is often adopted to transmit a driving force from a drive source to each roller.

In the known inkjet recording apparatus, a maintenance unit for performing maintenance of the recording head is disposed at a position that is outer than the conveyance path in the scanning direction and where the maintenance unit is allowed to face the recording head. For example, the maintenance of the recording head performed by the maintenance unit includes a purge in which ink is sucked from the nozzles of the recording head to prevent ink from drying in the recording head or to prevent the nozzles from being clogged with ink, or to eliminate air bubbles from the recording head.

The above-described inkjet recording apparatus uses the gear train to transmit the driving force from the drive source to each roller and includes the maintenance unit to perform maintenance of the recording head.

SUMMARY

In such an inkjet recording apparatus, the rollers may be disposed on opposite sides of the recording head in a recording-medium conveyance direction. Therefore, the gear train may be disposed near the maintenance unit.

In the known inkjet recording apparatus, the gears constituting the gear train that may transmit the driving force from the drive source to each roller may be supported by a member other than the maintenance unit. Thus, a large space may be required to support the gears constituting the gear train.

Accordingly, aspects of the disclosure have been made in light of the above-described problem. That is, aspects of the disclosure provide for an inkjet recording apparatus that requires less space for installation of a gear train that may transmit a driving force from a drive source to each roller and a maintenance unit that may perform maintenance of a recording head.

In at least one aspect, an inkjet recording apparatus including a recording head, a carriage, a maintenance unit and a base unit. The recording head configured to record an image onto a recording medium conveyed in a conveyance direction by ejecting ink droplets from nozzles. The carriage configured to support the recording head and move in a width direction orthogonal to the conveyance direction. The maintenance unit disposed within a movable range of the carriage and configured to perform maintenance of the recording head in a state where the maintenance unit faces the recording head. The base unit made of resin and having a one-piece structure and including a wall portion. The base unit configured to support the maintenance unit. The base unit including a plurality of gear shafts integral with the wall portion and the plurality of gear shafts protruding from the wall portion of the base unit in the width direction.

According to the above-described configuration, the base unit in which the maintenance unit may be disposed may be made of resin and may have the one-piece structure. Further, the base unit may comprise the gear shafts integral with the base unit. Therefore, this configuration might not require another member for placing the gear shafts thereon, in addition to the base unit. Thus, this configuration may reduce space required for installation of the gears and the maintenance unit inside the image recording apparatus.

According to the aspects of the disclosure, the space required for installation of the gear train that may transmit the driving force from the drive source to each roller and the maintenance unit that may perform maintenance of the recording head may be reduced.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION OF EMBODIMENTS

Figure 1:
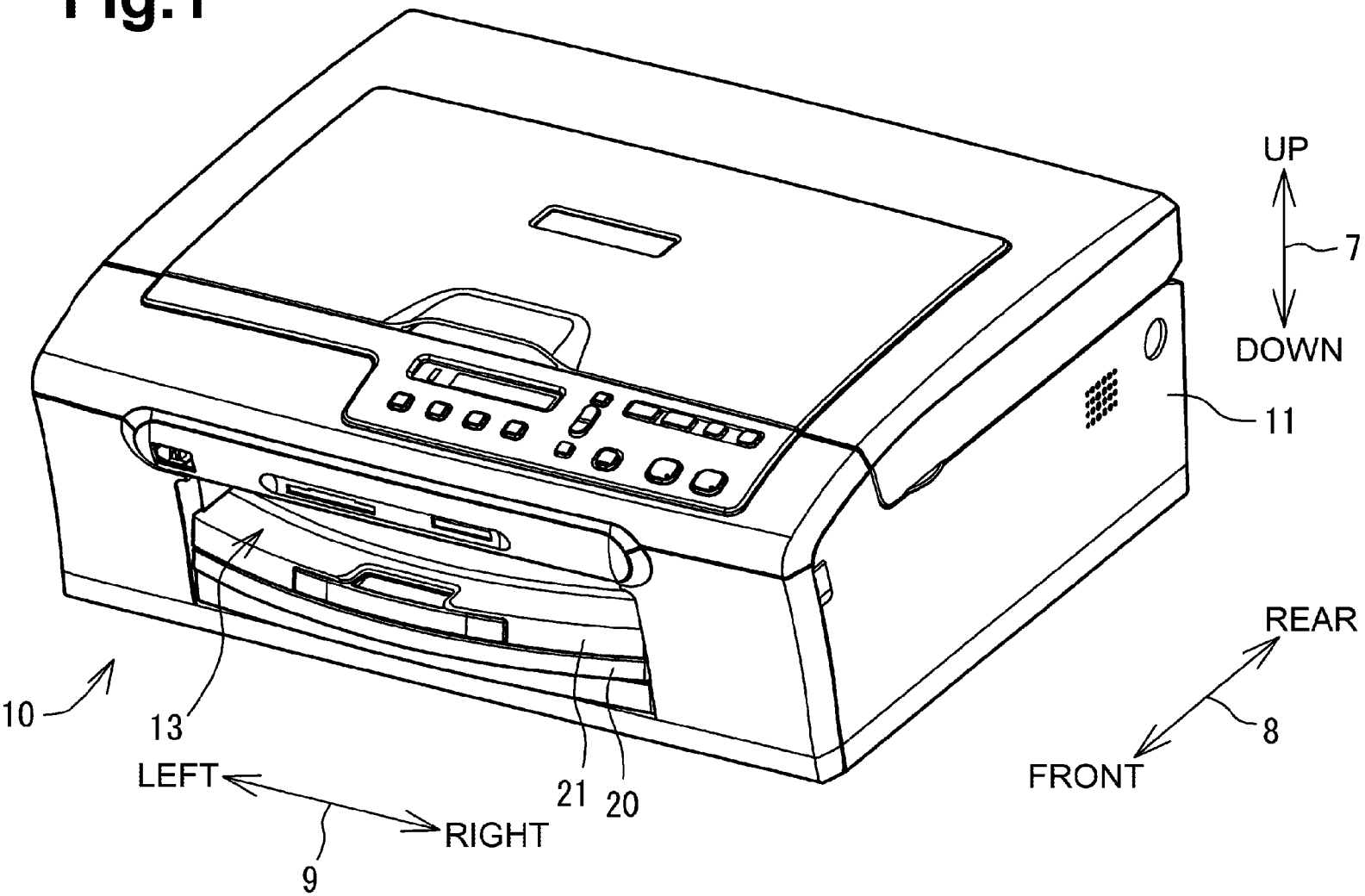
FIG. 1 is a perspective view depicting an appearance of a multifunction device in an illustrative embodiment according to one or more aspects of the disclosure.

An illustrative embodiment according to one or more aspects is described below with reference to the accompanying drawings. The illustrative embodiment described below is merely an example. Various changes, arrangements and modifications may be applied therein without departing from the spirit and scope of the disclosure. In the description below, an up-down direction 7 may be defined with reference to an orientation of a multifunction device 10 that may be disposed in which it may be intended to be used (e.g., an orientation depicted in FIG. 1). A side of the multifunction device 10, in which an opening 13 may be defined, may be defined as the front of the multifunction device 10. A front-rear direction 8 may be with reference to the front of the multifunction device 10. A right-left direction 9 may be defined with respect to the multifunction device 10 as viewed from its front.

Overall Configuration of Multifunction Device 10

As depicted in FIG. 1, the multifunction device 10 (as an example of an inkjet recording apparatus) may comprise a printer unit 11 at its lower portion. The multifunction device 10 may have various functions, for example, a facsimile function and a printing function through conventional facsimile and printing hardware, software, and computer control units (e.g., processors). The multifunction device 10 may have a function of recording an image onto one side of a recording sheet 12 (see FIG. 2), as the printing function. In other embodiments, for example, the multifunction device 10 may be configured to record an image onto each side of a recording sheet 12. The printer unit 11 may have the opening 13 defined in its front. A feed tray 20 (as an example of a tray) and an output tray 21, both of which may be allowed to be loaded with one or more recording sheets 12 thereon, may be configured to be inserted into and removed from the printer unit 11 via the opening 13 in the front-rear direction 8. One or more recording sheets 12 may be supported by the feed tray 20. The one or more recording sheets 12 on which an image has been recorded by a recording unit 24 may be outputted onto the output tray 21.

Feeder Unit 14

Figure 2:
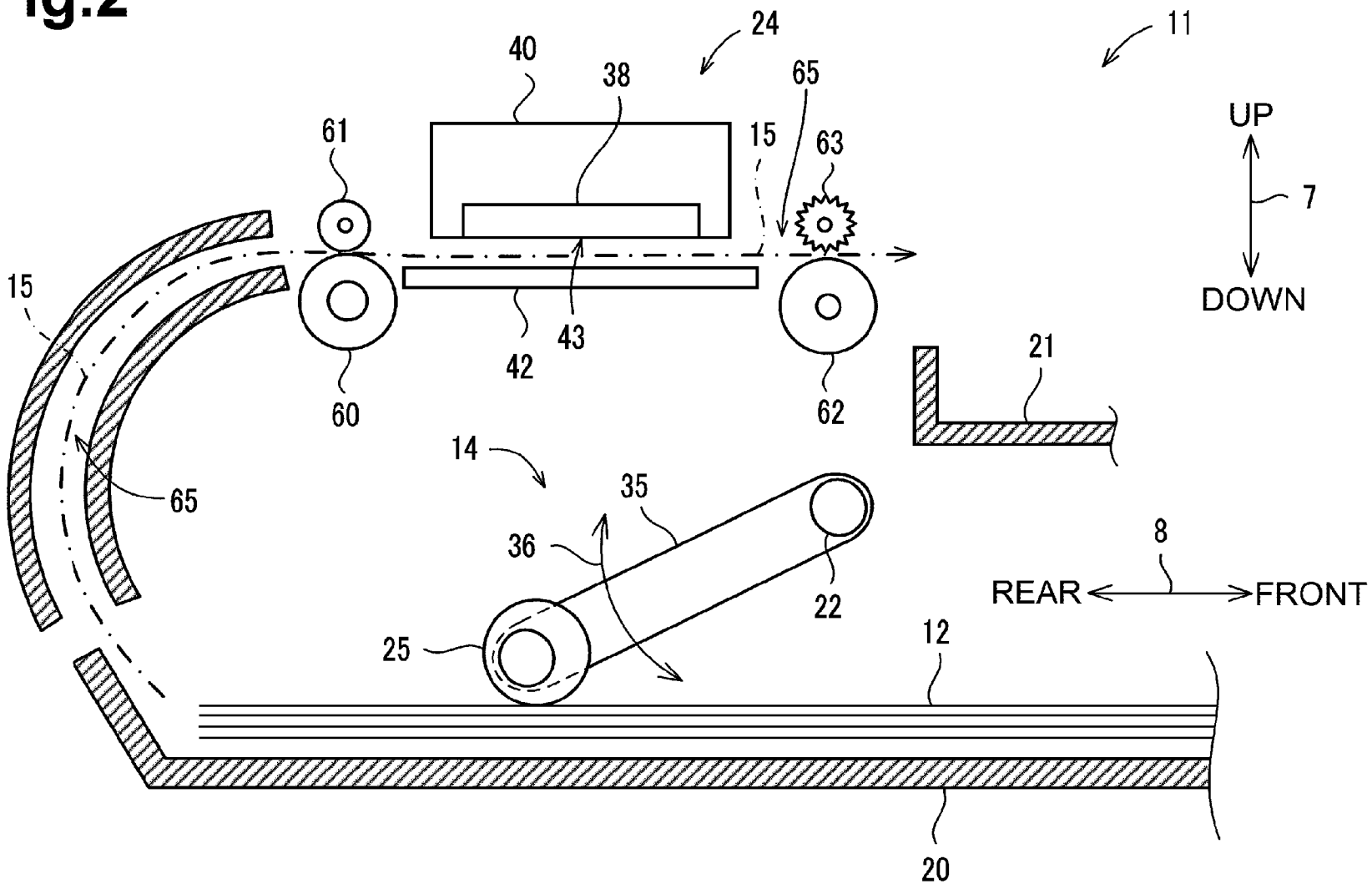
FIG. 2 is a schematic vertical sectional view depicting an internal configuration of a printer unit in the illustrative embodiment according to one or more aspects of the disclosure.
Figure 6:
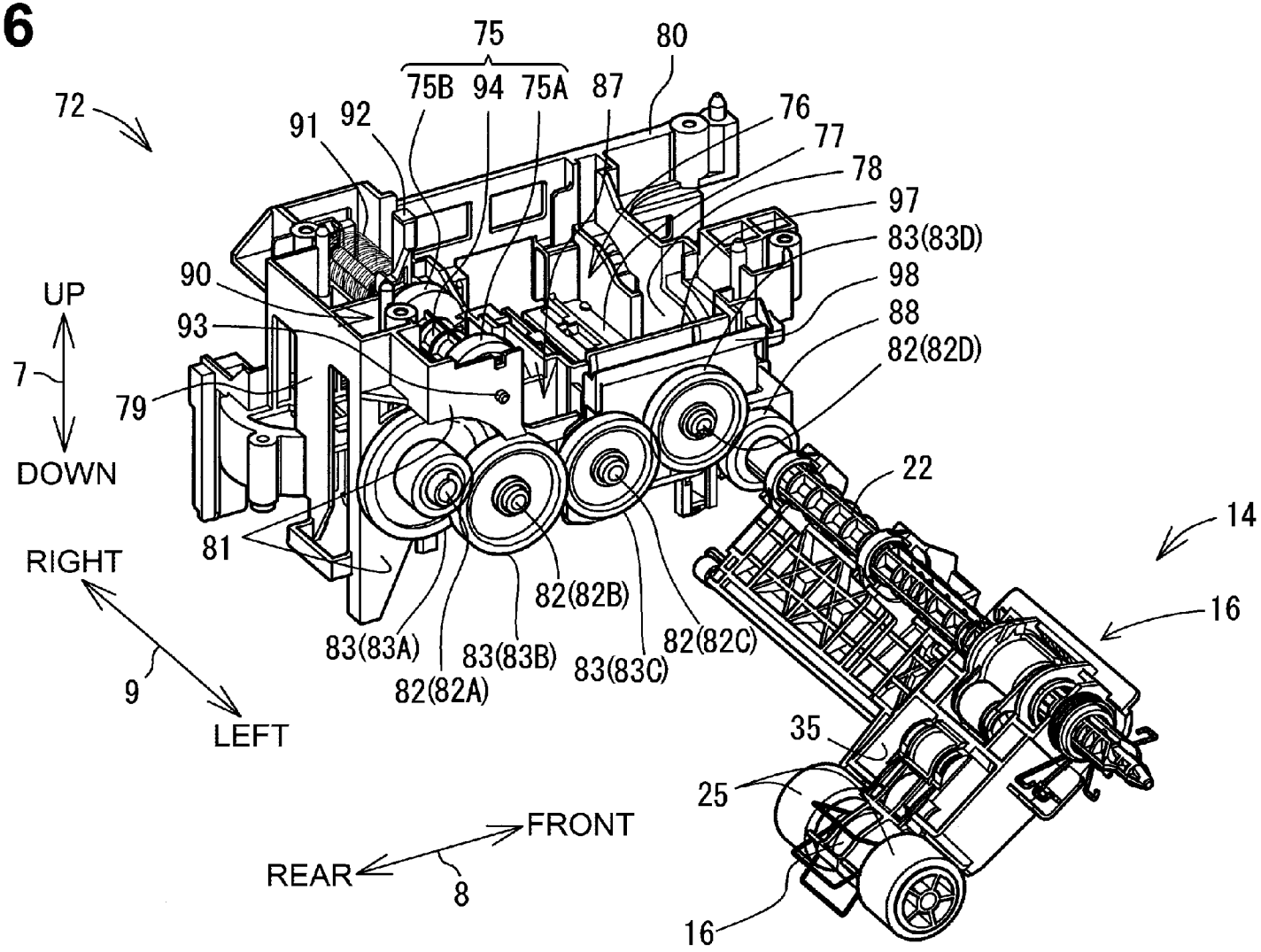
FIG. 6 is a perspective view depicting the base unit, transmission gears, and a feeder unit in the illustrative embodiment according to one or more aspects of the disclosure.
Figure 7:
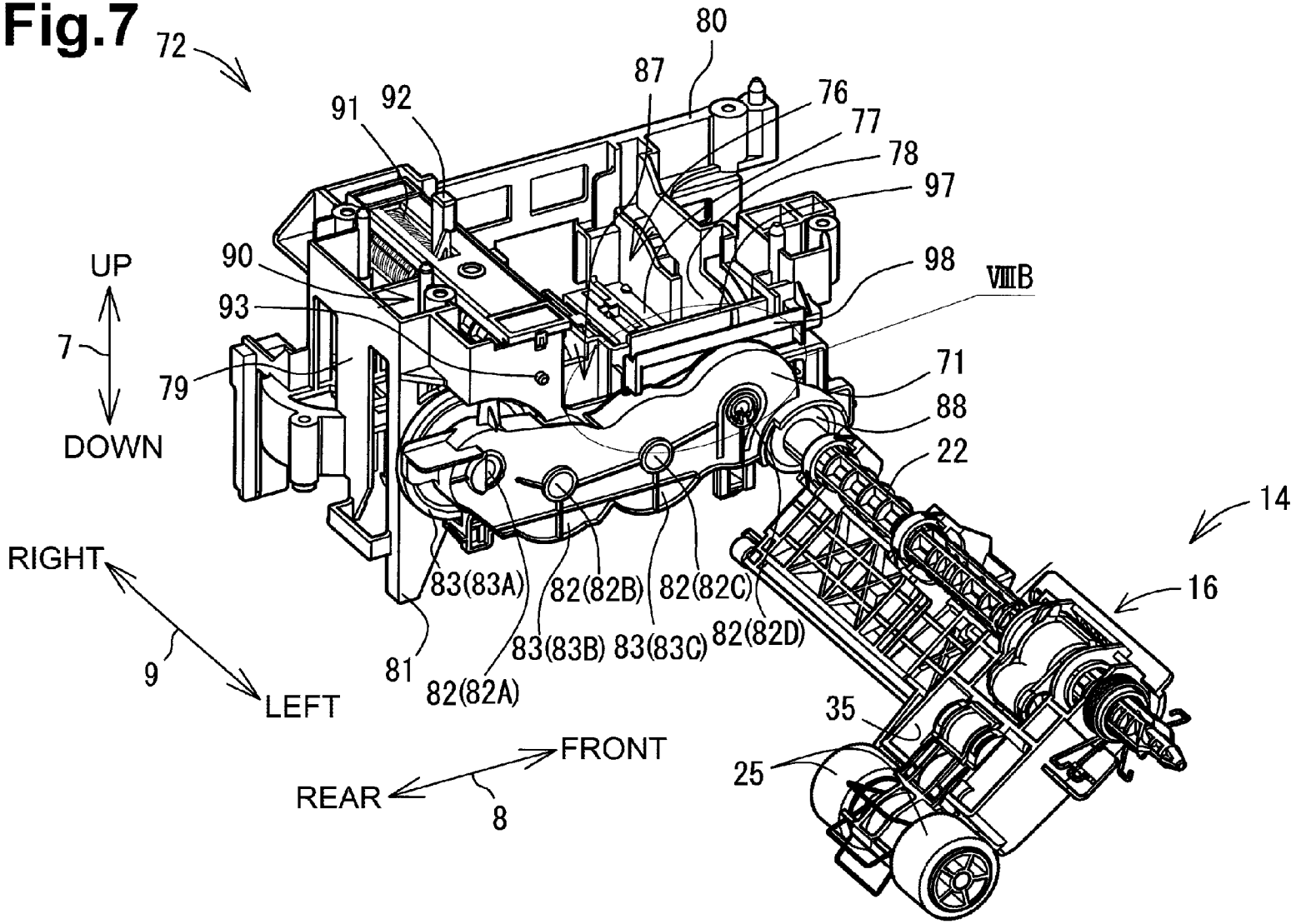
FIG. 7 is a perspective view depicting a gear cover as well as the base unit, the transmission gears, and the feeder unit depicted in FIG. 6 in the illustrative embodiment according to one or more aspects of the disclosure.

As depicted in FIG. 2, a feeder unit 14 may be disposed above the feed tray 20. As depicted in FIGS. 2 and 6, the feeder unit 14 may comprise feed rollers 25, a feed arm 35 (as an example of an arm), a shaft portion 22, and a power transmission portion 16. The feed rollers 25 may be rotatably supported at a distal end portion of the feed arm 35.

The shaft portion 22 may be disposed at a proximal end portion of the feed arm 35 to extend in the right-left direction 9. That is, the shaft portion 22 may be disposed at the position different from the feed rollers 25 in the feed arm 35. The shaft portion 22 may be rotatably supported by a shaft support portion 73 (see FIG. 5) of a base unit 72. More specifically, the shaft portion 22 may have a hole in its right end and the shaft support portion 73 may be supported in the hole of the shaft portion 22.

The feed arm 35 may be swingably supported by the shaft portion 22. More specifically, the feed arm 35 may be disposed on the shaft portion 22 and may be swingable on the shaft portion 22 in directions indicated by an arrow 36. With this configuration, the feed rollers 25 may be allowed to come into contact with and move away from the feed tray 20 or the one or more recording sheets 12 supported by the feed tray 20. That is, the shaft portion 22 may support the feed arm 35 so as to be swingable in directions that the feed rollers 25 may come into contact with and move away from the feed tray 20. The feed arm 35 may have an internal space, and the power transmission portion 16 may be disposed in the internal space of the feed arm 35.

The power transmission portion 16 may comprise a plurality of gears that may be engaged with one another. Of the plurality of gears, a gear that may be disposed nearest to the proximal end portion of the feed arm 35, may be disposed on the shaft portion 22 and may rotate integrally with the shaft portion 22. Of the plurality of gears, a gear that may be disposed nearest to the distal end portion of the feed arm 35, may be disposed on a shaft of the feed rollers 25 and may rotate integrally with the feed rollers 25. With this configuration, a rotational driving force of the shaft portion 22 may be transmitted to the feed rollers 25 by the power transmission portion 16.

The feed rollers 25 may rotate by the application of the driving force from a conveyor motor (not depicted) via the power transmission portion 16. The mechanism of the power transmission from the conveyor motor to the feed rollers 25 is described later. With the rotation of the feed rollers 25, the one or more recording sheets 12 placed on the feed tray 20 may be fed to a conveyor roller 60 through a conveyance path 65. In other embodiments, for example, the feed rollers 25 may rotate by application of a driving force from another motor provided apart from the conveyor motor.

Conveyance Path 65

As depicted in FIG. 2, the conveyance path 65 may extend from a rear end of the feed tray 20. The conveyance path 65 may comprise a curved section and a straight section. The curved section may extend upward from the rear end of the feed tray 20 and be curved toward the front in the front-rear direction 8. The straight section may extend along the front-rear direction 8. The one or more recording sheets 12 placed on the feed tray 20 may be conveyed upward one by one from below so as to be U-turned in the curved section, and then, may be further conveyed in the straight section toward the recording unit 24 in the front-rear direction 8. The recording sheet 12 on which an image has been recorded by the recording unit 24 may be further conveyed in the straight section along the front-rear direction 8 and then outputted onto the output tray 21. That is, the recording sheet 12 may be conveyed along a conveyance direction 15 indicated by a dotted-and-dashed line with an arrow in FIG. 2.

Conveyor Roller 60 and Discharge Roller 62

As depicted in FIG. 2, in the conveyance path 65, a roller pair comprising the conveyor roller 60 and a pinch roller 61 that may be in contact with each other may be disposed in rear of the recording unit 24, and another roller pair comprising a discharge roller 62 and a spur roller 63 that may be in contact with each other may be disposed in front of the recording unit 24. Each roller pair may rotate with pinching the recording sheet 12 therebetween, thereby conveying the recording sheet 12 in the conveyance direction 15.

Figure 3:
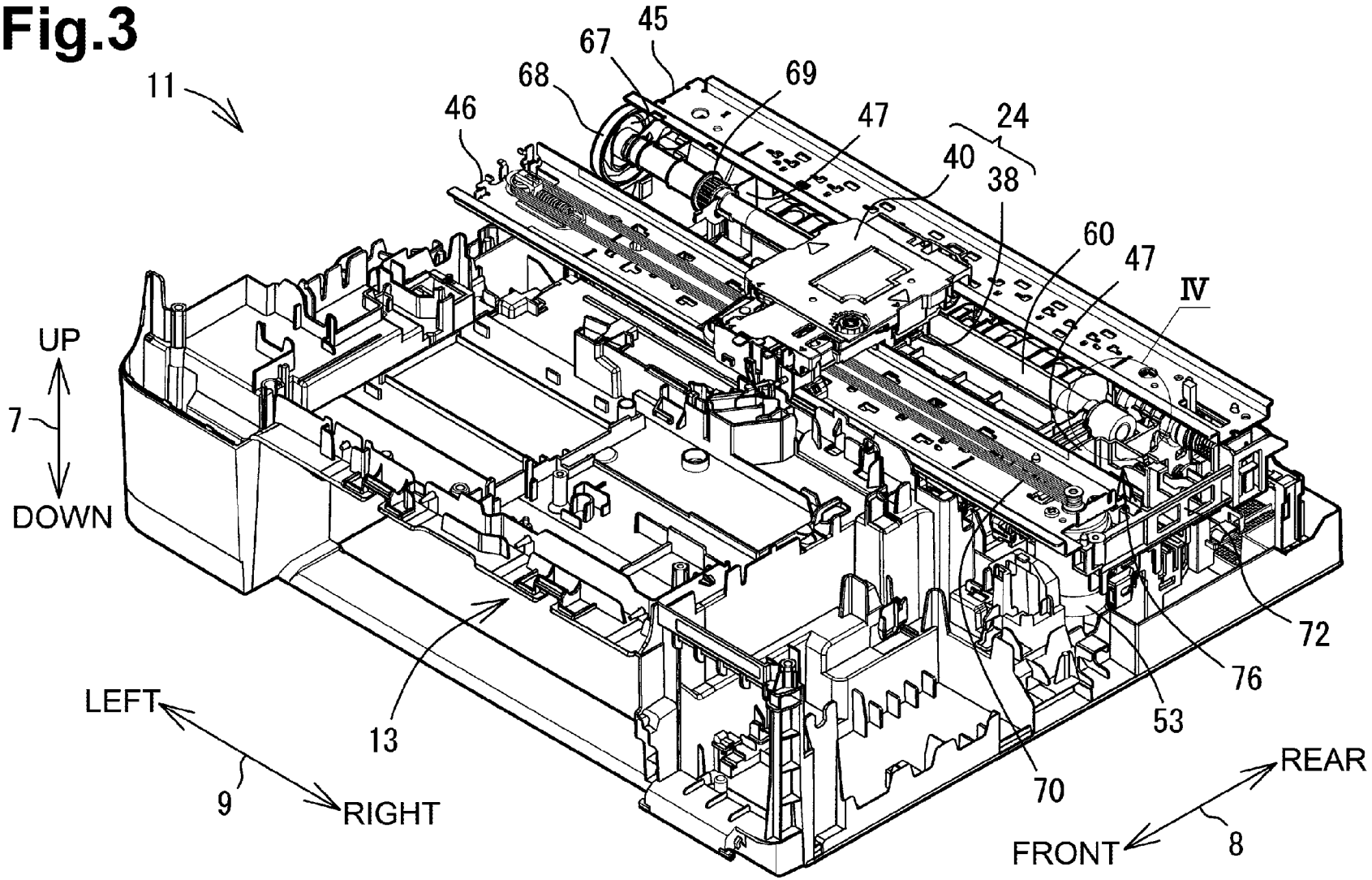
FIG. 3 is a perspective view of the printer unit in the illustrative embodiment according to one or more aspects of the disclosure.

The conveyor roller 60 may rotate by the application of the driving force from the conveyor motor. In the illustrative embodiment, as depicted in FIG. 3, an endless annular belt 68 may be disposed between a pulley 67 disposed on a shaft of the conveyor roller 60 and a pulley (not depicted) disposed on a shaft of the conveyor motor. With this configuration, as the conveyor motor rotates, the conveyor roller 60 may also rotate. The pinch roller 61 may rotate following the rotation of the conveyor roller 60.

Figure 4:
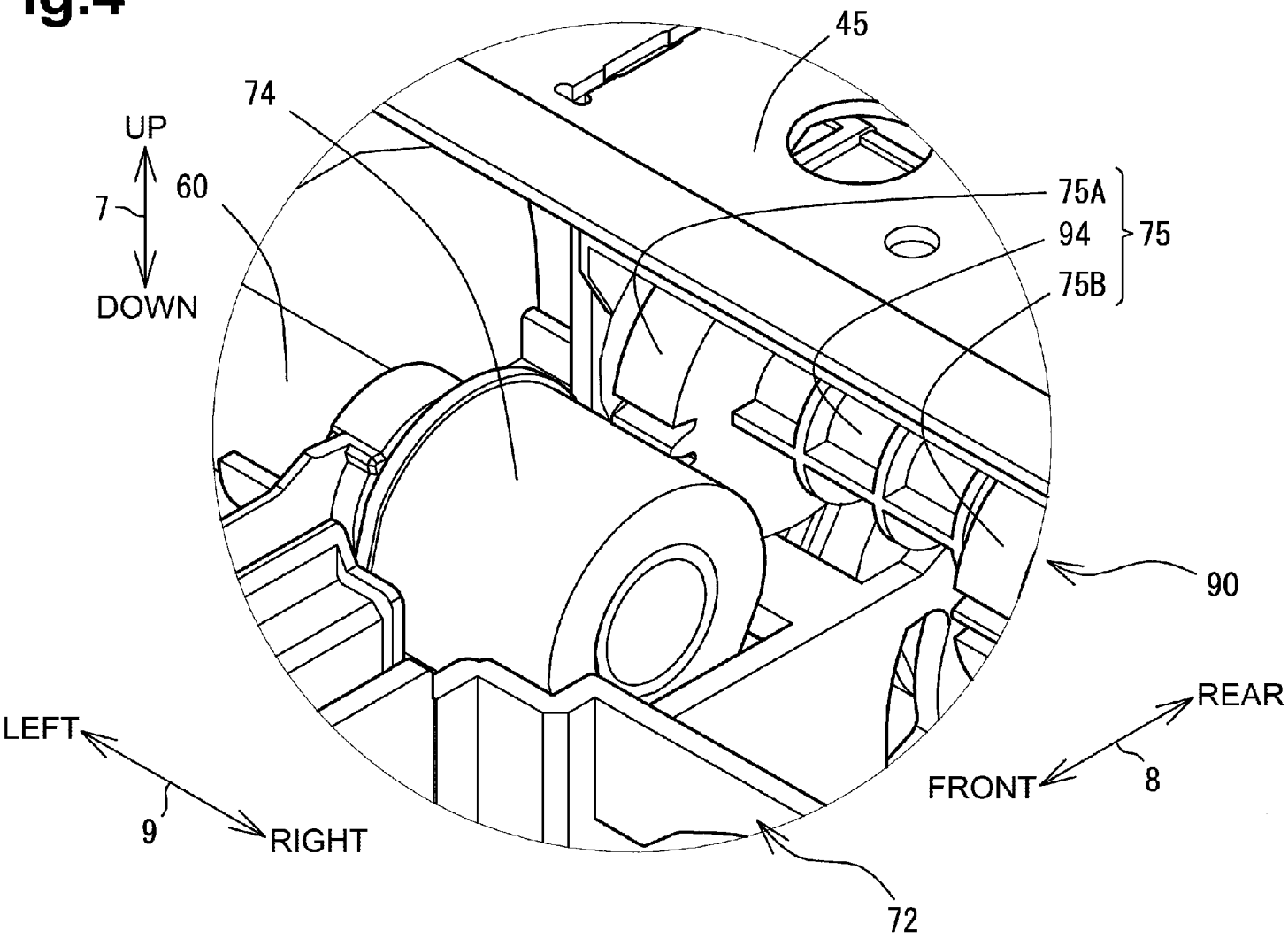
FIG. 4 is an enlarged view depicting a portion indicated with a reference numeral IV in FIG. 3 in the illustrative embodiment according to one or more aspects of the disclosure.

As depicted in FIG. 4, a drive gear 74 may be attached to the conveyor roller 60. The drive gear 74 may be disposed on a right end portion of the conveyor roller 60. The drive gear 74 may be in engagement with a sliding gear 75. In the illustrative embodiment, the drive gear 74 may be disposed on the conveyor roller 60. Nevertheless, in other embodiments, for example, the drive gear 74 may be disposed as another member apart from the conveyor roller 60. In this case, also, the drive gear 74 may rotate by the application of the driving force from a drive source (e.g., the conveyor motor or another motor).

The conveyor roller 60 may be rotatably supported by a pair of side frames 47 at its both end portions in the right-left direction 9. That is, the side frames 47 may be disposed facing each other in the right-left direction 9.

Similar to the conveyor roller 60, the discharge roller 62 may rotate by the application of the driving force from the conveyor motor. In the illustrative embodiment, another endless annular belt (not depicted) may be disposed between a pulley (not depicted) disposed on a left end portion of a shaft of the discharge roller 62 and a pulley 69 (see FIG. 3) disposed on a left end portion of the shaft of the conveyor roller 60. With this configuration, as the conveyor roller 60 rotates by the application of the driving force from the conveyor motor, the discharge roller 62 may also rotate in conjunction with the rotation of the conveyor roller 60. The spur roller 63 may rotate following the rotation of the discharge roller 62.

Recording Unit 24

As depicted in FIG. 2, the recording unit 24 may be disposed between the conveyor roller 60 and the discharge roller 62 in the straight section. A platen 42 may be disposed below and facing the recording unit 24. The platen 42 may be a member configured to support a recording sheet 12 being conveyed along the conveyance path 65. The recording unit 24 may be configured to record an image onto the recording sheet 12 supported by the platen 42 using a known inkjet recording method. The recording unit 24 may comprise a recording head 38 comprising a nozzle surface 43 in which a plurality of nozzles may be defined to eject ink droplets toward the recording sheet 12, and a carriage 40 equipped with the recording head 38.

As depicted in FIG. 3, the carriage 40 may be supported by guide rails 45 and 46 (as an example of a support frame) such that the carriage 40 may be allowed to reciprocate in the right-left direction 9 (as an example of a width direction) orthogonal to the front-rear direction 8 that may correspond to the conveyance direction 15 in the straight section. The guide rails 45 and 46 may be supported by the pair of side frames 47 at their both end portions in the right-left direction 9. That is, the conveyor roller 60 and the recording unit 24 supported by the guide rails 45 and 46 both may be supported by the side frames 47.

The carriage 40 may be connected to a carriage drive motor 53 via a known belt mechanism 70. The carriage 40 may reciprocate in the right-left direction 9 by the transmission of a driving force from the carriage drive motor 53 via the belt mechanism 70. The carriage 40 may reciprocate while a recording sheet 12 is supported by the platen 42. The recording head 38 may eject ink droplets from the nozzles while the carriage 40 reciprocates. Thus, an image may be recorded on the recording sheet 12 supported by the platen 42.

Base Unit 72

As depicted in FIG. 3, the base unit 72 may be disposed in a right end portion of the printer unit 11 in the right-left direction 9. The base unit 72 may also be disposed between the guide rail 45 and the guide rail 46 in the front-rear direction 8. Further, the base unit 72 may be disposed below the recording head 38 in the up-down direction 7. More specifically, when the carriage 40 is located at a right end position within a movable range thereof, the base unit 72 may be located under the recording head 38 mounted on the carriage 40 and may face the recording head 38.

The carriage 40 may move above the conveyance path 65 in the right-left direction 9. The base unit 72 may be disposed at a further right position than the conveyance path 65. That is, the movable range of the carriage 40 may comprise at least the above of the conveyance path 65 and the above of the base unit 72.

The base unit 72 may be disposed on the guide rails 45 and 46. More specifically, an upper side of a rear end portion of the base unit 72 may be attached to the guide rail 45 and an upper side of a front end portion of the base unit 72 may be attached to the guide rail 46.

Figure 5:
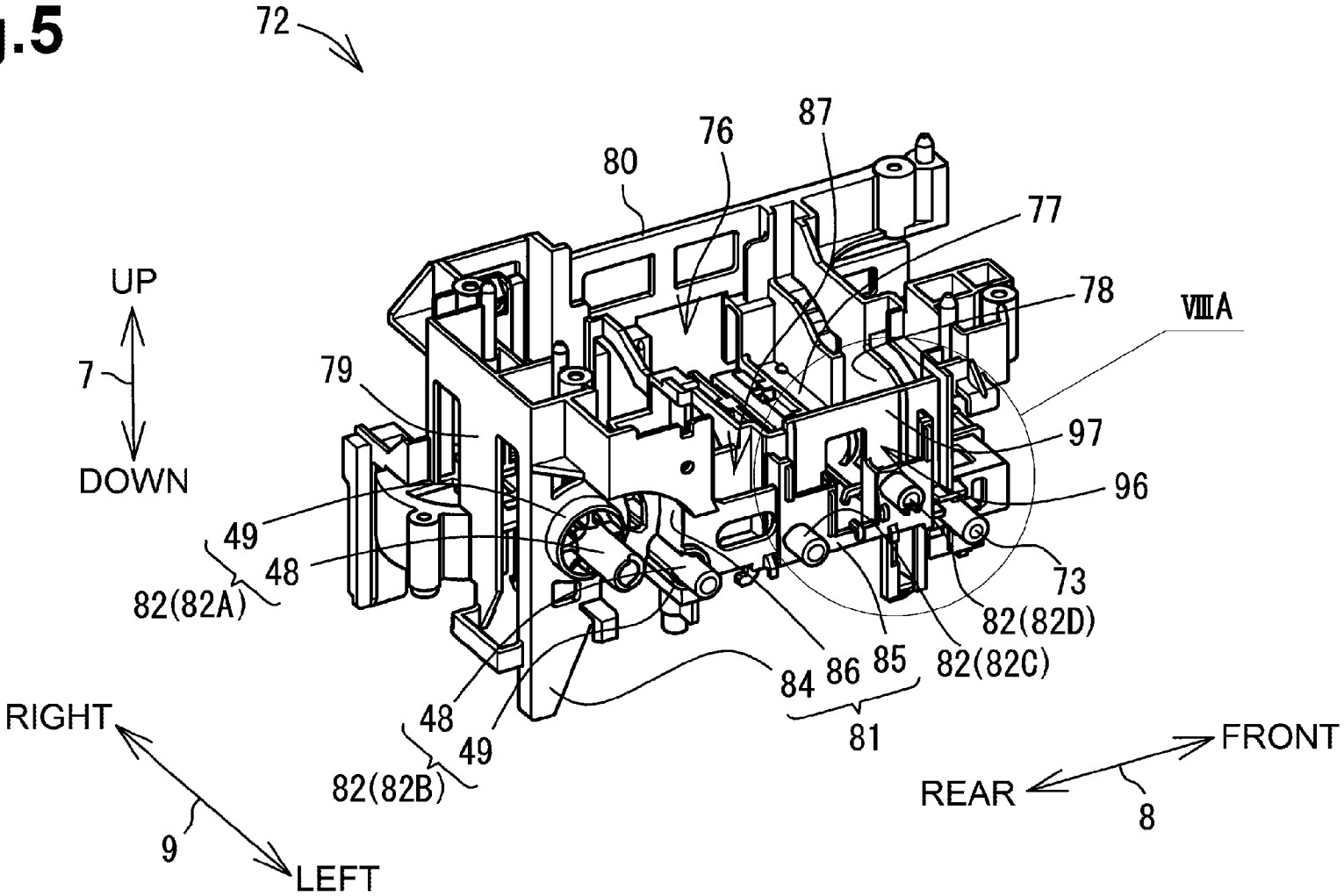
FIG. 5 is a perspective view depicting a base unit in the illustrative embodiment according to one or more aspects of the disclosure.

As depicted in FIG. 5, the base unit 72 may have a substantially box shape with its top opened. That is, the base unit 72 may be a box-shaped member of which one side opposing the recording head 38 may be opened with an opening 76 that may be a space. The base unit 72 may be made of, for example, PBT resin or ABS resin, and have a one-piece structure. For instance, the base unit 72 may be molded by which the above resin softened by heat may be poured into a mold shaped in the base unit 72 as depicted in FIG. 5.

The base unit 72 may comprise a bottom wall portion 77, a front wall portion 78, a rear wall portion 79, a right wall portion 80, and a left wall portion 81 (as an example of a wall portion) to define the opening 76. In other embodiments, for example, the base unit 72 may comprise at least one or some of the wall portions 77 to 81. For instance, the base unit 72 may comprise the left wall portion 81 only.

The left wall portion 81 may have a step in its middle portion in the front-rear direction 8 (more specifically, in a slightly rearward portion). More specifically, the left wall portion 81 may comprise a first surface 84 constituting a rearward portion, a second surface 85 constituting a forward portion, and a third surface 86 connecting the first surface 84 and the second surface 85. The first surface 84 and the second surface 85 may extend in the front-rear direction 8 and in the up-down direction 7. The first surface 84 may be located at a more right position than the second surface 85. In the illustrative embodiment, the third surface 86 may extend in the right-left direction 9 and in the up-down direction 7. That is, in the illustrative embodiment, the third surface 86 may extend in the right-left direction 9. Nevertheless, in other embodiments, the third surface 86 may extend in a direction oblique to the right-left direction 9 as long as the third surface 86 may connect the first surface 84 and the second surface 85 or be omitted with first surface 84 and second surface 85 forming a common surface.

Maintenance Unit 66

Figure 9:
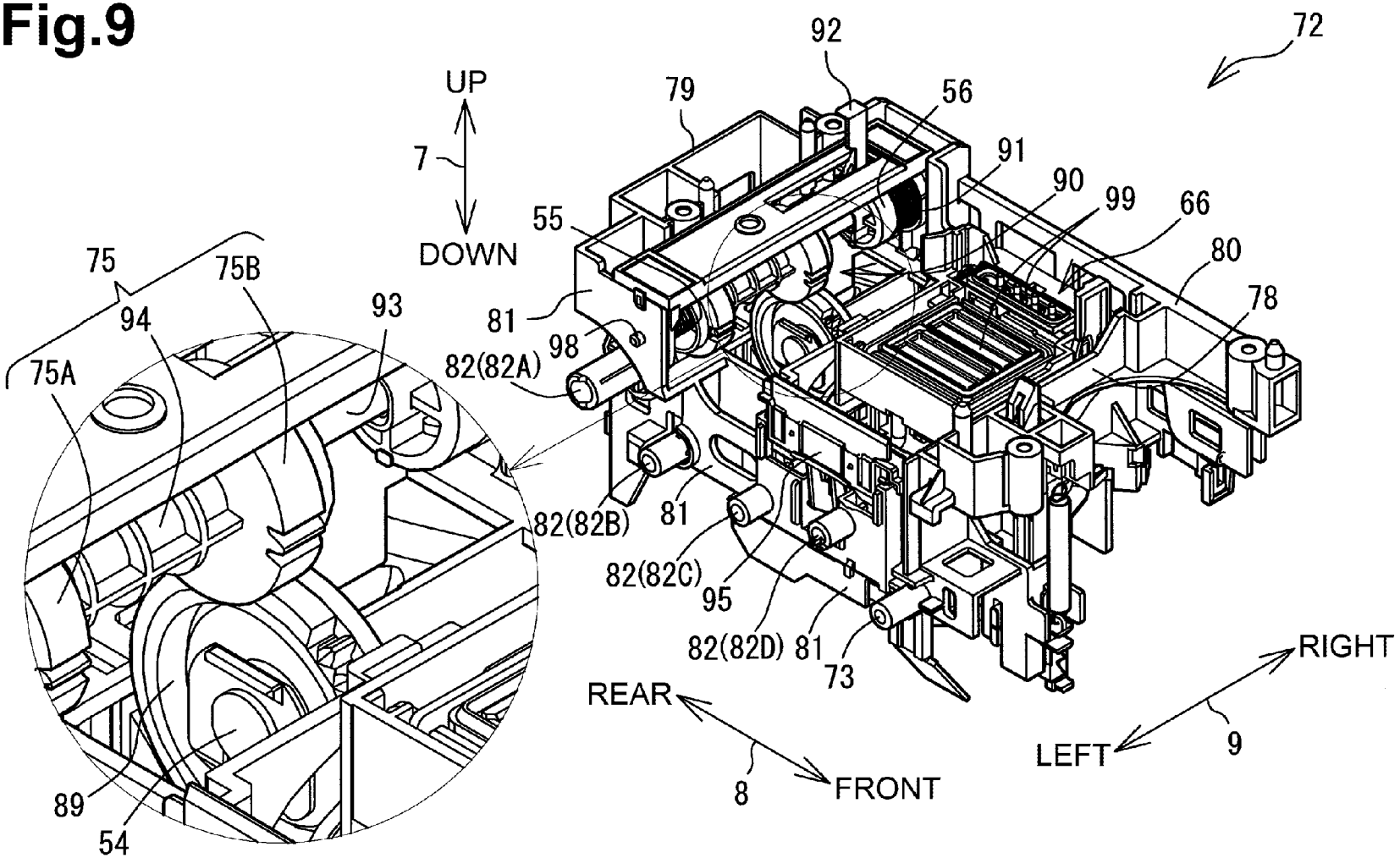
FIG. 9 is a perspective view depicting the base unit in which the maintenance unit is disposed in the illustrative embodiment according to one or more aspects of the disclosure.
Figure 10B:
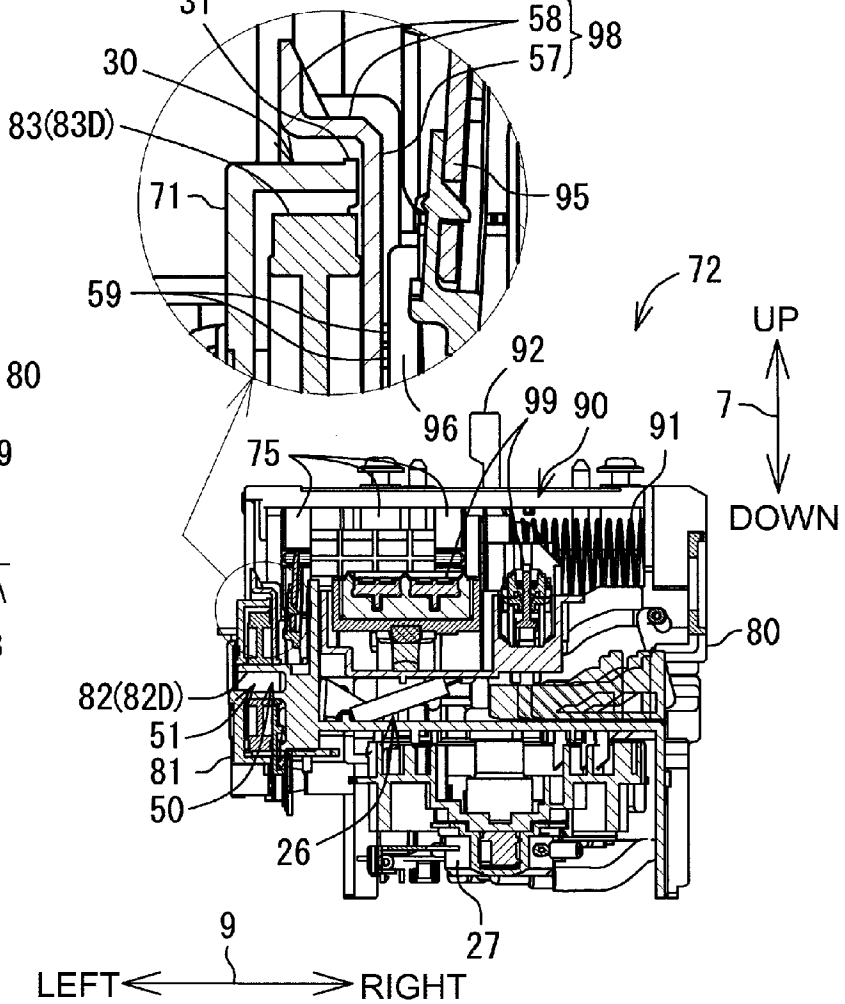
FIG. 10B is a sectional view taken along line B-B of FIG. 10A in the illustrative embodiment according to one or more aspects of the disclosure.
Figure 10A:
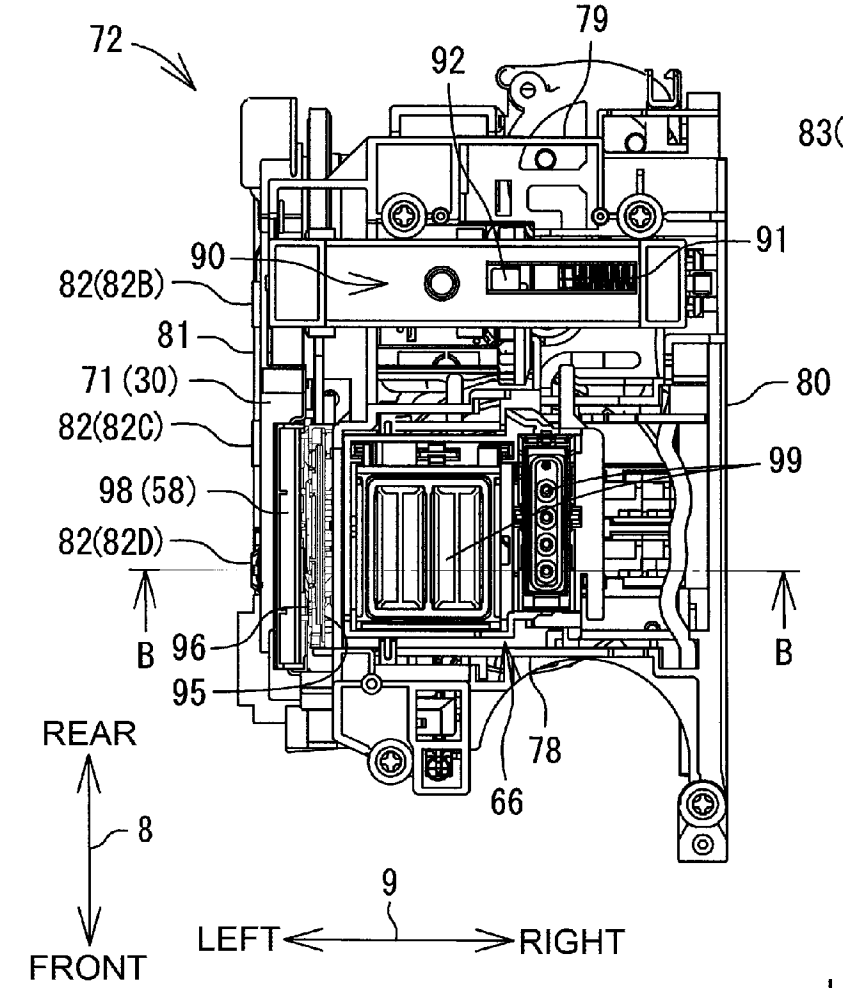
FIG. 10A is a plan view of the base unit in the illustrative embodiment according to one or more aspects of the disclosure.

As depicted in FIGS. 9 and 10A, a maintenance unit 66 may be disposed in the internal space of the base unit 72. In other words, the maintenance unit 66 may be disposed in the opening 76 of the base unit 72. In FIGS. 3 to 7, the maintenance unit 66 and a maintenance gear 89 are omitted.

The maintenance unit 66 may be attached to at least one of the bottom wall portion 77, the front wall portion 78, the rear wall portion 79, the right wall portion 80, and the left wall portion 81 of the base unit 72 in a way of using a screw or engagement. That is, the maintenance unit 66 may be attached to the base unit 72.

As described above, the base unit 72 may be disposed facing the recording head 38 mounted on the carriage 40 when the carriage 40 is located at the right end position within its movable range. That is, the maintenance unit 66 disposed in the base unit 72 may be situated within the movable range of the carriage 40.

The maintenance unit 66 may be configured to prevent ink from drying in the nozzles of the recording head 38 and eliminate air bubbles and/or foreign matter from the nozzles by suction.

As depicted in FIG. 10B, the maintenance unit 66 may comprise caps 99, a cap driving mechanism 26, a pump (not depicted), a waste liquid tank (not depicted), and a pump tube (not depicted). The caps 99 may be moved up and down by the cap driving mechanism 26 to come into contact with and move away from the recording head 38. The pump may suck ink, air bubbles, and/or foreign matter present in the nozzles via tubes connected to the respective caps 99. The waste liquid tank may store ink (and/or the other material) sucked by the pump out of the nozzles via the pump tube connected to the pump.

Hereinafter, an ink suction operation performed by the maintenance unit 66 is described. As the ink suction operation is started, first, the carriage 40 may move rightward to a position where the nozzles of the recording head 38 may be located right above the caps 99. Then, the caps 99 may be moved upward by the cap driving mechanism 26. Thus, the caps 99 may move from the position where the caps 99 may be separated from the recording head 38 to the position where the caps 99 may contact the recording head 38. As a result, the nozzles located in a lower surface of the recording head 38 may be covered with the caps 99. Then, the pump may be driven with the nozzles as covered with the caps 99. By doing so, ink, air bubbles, and/or foreign matter in the nozzles may be sucked out of the nozzles by the pump and sent to the waste liquid tank via the tubes. Thus, the maintenance unit 66 may perform the maintenance of the recording head 38 while facing the recording head 38.

As depicted in FIG. 9, the maintenance gear 89 that may be configured to drive the maintenance unit 66 by its rotation may be disposed in the opening 76 of the base unit 72. For example, the maintenance gear 89 may comprise a switch member 27 (see FIG. 10B) that may be configured to drive the pump by the transmission of the driving force from the conveyor motor that may rotate in a normal direction and to switch a communication status of the caps 99 with respect to the atmosphere between an in-communication status and a shield status by the transmission of the driving force from the conveyor motor that may rotate in a reverse direction.

The maintenance gear 89 may be disposed behind the maintenance unit 66 in the opening 76. The maintenance gear 89 may be rotatably supported by the base unit 72. More specifically, the base unit 72 may comprise a shaft 54 that may be monolithic with the base unit 72. The maintenance gear 89 may be disposed on the shaft 54. The maintenance gear 89 may rotate on the shaft 54 by the application of the driving force from the sliding gear 75.

The shaft 54 of the maintenance gear 89 may be disposed in front of a shaft 93 of the sliding gear 75 in the front-rear direction 8. As depicted in FIG. 6, a gear shaft 82A of a transmission gear 83A may be disposed behind the shaft 93 of the sliding gear 75 in the front-rear direction 8. As described above, the maintenance gear 89 may rotate on the shaft 54 that may be different from the gear shaft 82A of the transmission gear 83A engaging the sliding gear 75 and may be monolithic with the base unit 72.

Gear Shaft 82

As depicted in FIG. 5, the left wall portion 81 constituting the base unit 72 may comprise a plurality of gear shafts 82, for example, four gear shafts 82A, 82B, 82C, and 82D in the illustrative embodiment. In the illustrative embodiment, each of the gear shafts 82 may have an internal space 51 (see FIG. 10B). That is, each of the gear shafts 82 may have a hollow structure. In other embodiments, for example, each of the gear shafts 82 might not necessarily have the hollow structure, and the inside of each of the gear shafts 82 may be filled with the resin forming the base unit 72 or may be solid being formed of singular material.

The gear shafts 82 may be monolithic with the left wall portion 81 and protrude in the right-left direction 9 (e.g., in the illustrative embodiment, the gear shafts 82 may protrude leftward from a left surface of the left wall portion 81). As depicted in FIG. 9, the maintenance unit 66 may be disposed on the right of the left wall portion 81. That is, the gear shafts 82 may protrude from the left surface of the left wall portion 81, wherein the left surface may opposite to a surface, facing the maintenance unit 66, of the left wall portion 81 in the right-left direction 9.

As depicted in FIG. 6, the gear shafts 82 may support transmission gears 83, respectively, so as to be rotatable, while being inserted in the transmission gears 83. The transmission gears 83, each of which may have an opening in a center of a thrust surface thereof, may be disposed on the respective gear shafts 82, wherein a diameter of the opening of each transmission gear 83 may be the same as or slightly larger than a diameter of each gear shaft 82. In the illustrative embodiment, for example, four transmission gears 83A, 83B, 83C, and 83D may be provided for the gear shafts 82A, 82B, 82C, and 82D, respectively. The transmission gears 83 may be an example of a transmission gear and an example of a gear. In other embodiments, for example, the transmission gears 83 may be inserted in the gear shafts 82, respectively. In this case, each gear shaft 82 may have a hole in its end surface and each transmission gear 83 may comprise a projection that may be inserted into the hole defined in its thrust surface that may face a corresponding one of the gear shafts 82.

A relationship between a location of each gear shaft 82 and a size of each transmission gear 83 may be determined to satisfy a predetermined condition. The predetermined condition may be that the transmission gears 83 may constitute a gear train in which the transmission gears 83 may be engaged with one another while the transmission gears 83 may be disposed on the gear shafts 82, respectively. The transmission gears 83 may have the same size or respective different sizes.

As depicted in FIG. 5, the gear shaft 82A that may support the transmission gear 83A, which may be in engagement with the sliding gear 75, of the plurality of transmission gears 83, may protrude from the first surface 84 of the left wall portion 81 of the base unit 72. The gear shafts 82B, 82C, and 82D that may support the transmission gears 83B, 83C, and 83D, respectively, which might not be in engagement with the sliding gear 75, of the plurality of transmission gears 83, may protrude from the second surface 85 of the left wall portion 81 of the base unit 72.

With respect to the up-down direction 7 orthogonal to the conveyance direction 15 and the right-left direction 9, the gear shaft 82A may be disposed at a higher position than the gear shaft 82D, the gear shaft 82D may be disposed at a higher position than the gear shaft 82C, and the gear shaft 82C may be disposed at a higher position than the gear shaft 82B. That is, the gear shafts 82A, 82B, 82C, and 82D may be disposed at respective different positions in the up-down direction 7.

The left wall portion 81 of the base unit 72 may have a recessed portion 87 that may be recessed downward from an upper end of the left wall portion 81. As depicted in FIGS. 3 and 4, the conveyor roller 60 may extend from the conveyance path 65 to the opening 76 of the base unit 72 beyond the recessed portion 87. The sliding gear 75 may be disposed at an upper rear position with respect to the drive gear 74 of the conveyor roller 60. As depicted in FIG. 6, the gear shaft 82A may be disposed at a lower rear position with respect to the sliding gear 75. That is, the gear shaft 82A and the shaft of the drive gear 74 may be disposed on opposite sides of the sliding gear 75 in the conveyance direction 15.

As depicted in FIG. 5, in the illustrative embodiment, each of the gear shafts 82A and 82B may comprise a shaft portion 48 and an interconnection portion 49. The shaft portion 48 may support the transmission gear 83. A diameter of the shaft portion 48 may be slightly smaller than the diameter of the opening of the transmission gear 83. The interconnection portion 49 may be disposed at one end, which may be located closer to the left wall portion 81, of each of the gear shafts 82A and 82B, wherein the one end of the interconnection portion 49 may be connected with the shaft portion 48 and the other end thereof may be connected with the left wall portion 81. A diameter of the interconnection portion 49 may be larger than the diameter of the shaft portion 48. In the illustrative embodiment, the diameter of the interconnection portion 49 of the gear shaft 82A may be larger than the diameter of the interconnection portion 49 of the gear shaft 82B. Nevertheless, in other embodiments, for example, the diameter of the interconnection portion 49 of the gear shaft 82A may be smaller than or the same as the diameter of the interconnection portion 49 of the gear shaft 82B. In other embodiments, for example, each of the gear shafts 82C and 82D may also comprise the shaft portion 48 and the interconnection portion 49.

As depicted in FIG. 5, the shaft support portion 73 may be disposed on the second surface 85 of the left wall portion 81. The shaft support portion 73 may be monolithic with the left wall portion 81 and protrude from the left wall portion 81 along the right-left direction 9 (e.g., protrude leftward from the second surface 85 in the illustrative embodiment).

As described above, the shaft support portion 73 may support the shaft portion 22 of the feeder unit 14 so as to be rotatable. As depicted in FIG. 6, a feed gear 88 may be disposed on a right end portion of the shaft portion 22. The feed gear 88 may be in engagement with the transmission gear 83D in a state where the shaft portion 22 may be supported by the shaft support portion 73.

Switch Mechanism 90

As depicted in FIGS. 6 and 9, a switch mechanism 90 may be disposed in the opening 76 of the base unit 72. The switch mechanism 90 may comprise the sliding gear 75, a first coil spring 91, a second coil spring 55, a lever 92, and a contact member 56.

The sliding gear 75 may be disposed above the maintenance gear 89 in the opening 76. The sliding gear 75 may be supported by the base unit 72 so as to be rotatable and movable along the right-left direction 9. More specifically, the shaft 93 of the sliding gear 75 may be disposed in the base unit 72. The shaft 93 may be integral with the base unit 72. The sliding gear 75 may have a hole that may extend in an extending direction of the shaft 93, that is, in the right-left direction 9, and the shaft 93 may pass through the hole of the sliding gear 75. This configuration may allow the sliding gear 75 to rotate and move along the right-left direction 9 between a first position and a second position that may be located at a further right position than the first position.

The sliding gear 75 may comprise, for example, two gears 75A and 75B that may be spaced apart from each other at a predetermined distance in the right-left direction 9. The two gears 75A and 75B may be connected with each other by a connection member 94. Thus, the two gears 75A and 75B and the connection member 94 constituting the sliding gear 75 may be monolithic each other.

As depicted in FIG. 4, the sliding gear 75 may be in engagement with the drive gear 74 that may be disposed on the conveyor roller 60, regardless of the location of the sliding gear 75 with respect to the right-left direction 9. That is, the sliding gear 75 may rotate by the application of the driving force from the conveyor motor via the conveyor roller 60, regardless of the location of the sliding gear 75 in the right-left direction 9.

As depicted in FIGS. 6 and 9, the first coil spring 91 may be located on the right of the sliding gear 75 while the shaft 93 may be disposed on the first coil spring 91. One end of the first coil spring 91 may be secured to the contact member 56 through which the shaft 93 may pass, and the other end of the first coil spring 91 may be secured to the right wall portion 80. The second coil spring 55 may be disposed on the left of the sliding gear 75 while the shaft 93 may pass through the second coil spring 55. One end of the second coil spring 55 may be secured to the sliding gear 75 and the other end of the second coil spring 55 may be secured to the left wall portion 81. An urging force of the first coil spring 91 on the contact member 56 may be greater than an urging force of the second coil spring 55 on the sliding gear 75.

The lever 92 may be monolithic with the contact member 56. The lever 92 may be disposed extending upward from the contact member 56. The lever 92 may be located on a moving path of the carriage 40. The sliding gear 75 may be pressed by the carriage 40 and thus move as described below.

While the lever 92 might not be pressed by the carriage 40, the sliding gear 75 may be pressed by the contact member 56 that may be urged by the first coil spring 91 having the urging force greater than the second coil spring 55, and thus, the sliding gear 75 may be located at the first position.

When the sliding gear 75 is located at the first position, the gear 75A of the sliding gear 75 may be in engagement with the transmission gear 83A and the gear 75B of the sliding gear 75 may be located at a more left position than the maintenance gear 89 and thus might not be in engagement with the maintenance gear 89. When the conveyor motor drives under this state, the driving force of the conveyor motor may be transmitted to the feed rollers 25 via the conveyor roller 60 (i.e. the drive gear 74), the sliding gear 75, the transmission gears 83A, 83B, 83C, and 83D, the feed gear 88, and the power transmission portion 16.

When the lever 92 is pressed by the carriage 40 that is moving rightward while the sliding gear 75 is located at the first position, the contact member 56 may move rightward to move away from the sliding gear 75. Then, the sliding gear 75 may move rightward by the urging of the second coil spring 55. Thus, the sliding gear 75 may move from the first position to the second position.

When the sliding gear 75 is located at the second position, the gear 75B of the sliding gear 75 may be in engagement with the maintenance gear 89 and the gear 75A of the sliding gear 75 may be located at a more right position than the transmission gear 83A of the plurality of transmission gears 83 and thus the gear 75A might not be in engagement with the transmission gear 83A. When the conveyor motor drives under this state, the driving force of the conveyor motor may be transmitted to the maintenance unit 66 (i.e., one of the pump and the switch member 27) via the conveyor roller 60 (i.e., the drive gear 74), the sliding gear 75, and the maintenance gear 89, wherein the pump may be driven when the conveyor motor rotates in the normal direction and the switch member 27 may be driven when the conveyor motor rotates in the reverse direction.

When the carriage 40 moves leftward while the sliding gear 75 is located at the second position, the carriage 40 may move away from the lever 92. Thus, the contact member 56 may move leftward by the urging of the first coil spring 91 and thus come into contact with the sliding gear 75. Then, the sliding gear 75 may be pressed by the contact member 56 that may be urged by the first coil spring 91 having the urging force greater than the second coil spring 55. Thus, the sliding gear 75 may move leftward against the urging force of the second coil spring 55. Therefore, the sliding gear 75 may move from the second position to the first position.

Wiper 95

As depicted in FIG. 5, the base unit 72 may comprise a wiper holder 96. The wiper holder 96 may comprise a front portion of the left wall portion 81, a wall portion 97 disposed on the right of the front portion of the left wall portion 81, and a connection portion that may connect a front portion of the bottom wall portion 77 and the wall portion 97. The wiper holder 96 may have an open top, and a wiper 95 (see FIG. 9) may be fitted in the wiper holder 96 via the open top. Thus, the wiper 95 may be disposed in the wiper holder 96. In the illustrative embodiment, the wiper 95 may be held by the connection portion of the wiper holder 96.

The wiper 95 may be disposed such that an upper end portion of the wiper 95 may protrude above the wiper holder 96. An upper end of the wiper 95 may be allowed to come into contact with the nozzle surface 43 of the recording head 38. With this configuration, while the recording head 38 passes over the wiper 95 by the movement of the carriage 40, the wiper 95 and the nozzle surface 43 may contact with each other. As a consequence, the wiper 95 may wipe off ink adhered to the nozzle surface 43.

In the illustrative embodiment, as depicted in FIG. 5, the gear shafts 82C and 82D of the four gear shafts 82A, 82B, 82C, and 82D may be disposed on a wall surface of the front portion of the left wall portion 81 of the wiper holder 96. In other embodiments, for example, all of the four gear shafts 82A, 82B, 82C, and 82D may be disposed on the wall surface constituting the wiper holder 96. That is, at least one of the plurality of gear shafts 82 may be disposed on the wall surface of the wiper holder 96.

Cover Portion 98

As depicted in FIGS. 6 and 10B, a cover portion 98 may be disposed on the left of the wiper holder 96 and on the right of the transmission gear 83 that may be disposed on the gear shaft 82. The cover portion 98 may be disposed in the base unit 72. The cover portion 98 may comprise an upright portion 57 and an extended portion 58.

The upright portion 57 may be a thin-plate-shaped member that may extend in the up-down direction 7 and in the front-rear direction 8. The upright portion 57 may be disposed in a standing manner to protrude above the transmission gears 83C and 83D. As depicted in FIG. 10B, the upright portion 57 may have two openings 50 (one of the two openings 50 is depicted in FIG. 10B.). The gear shafts 82C and 82D may pass through the respective openings 50.

The extended portion 58 may extend leftward, that is, toward the transmission gear 83, from an upper end of the upright portion 57 in the right-left direction 9. The extended portion 58 may be monolithic with the upright portion 57. In the illustrative embodiment, one end of the extended portion 58 may be located at a more left position than the transmission gear 83 (more specifically, the transmission gear 83D). The one end of the extended portion 58 may be bent upward. That is, the one end of the extended portion 58 may be located at a higher position than the other end (i.e., a base end) thereof.

Figure 8B:
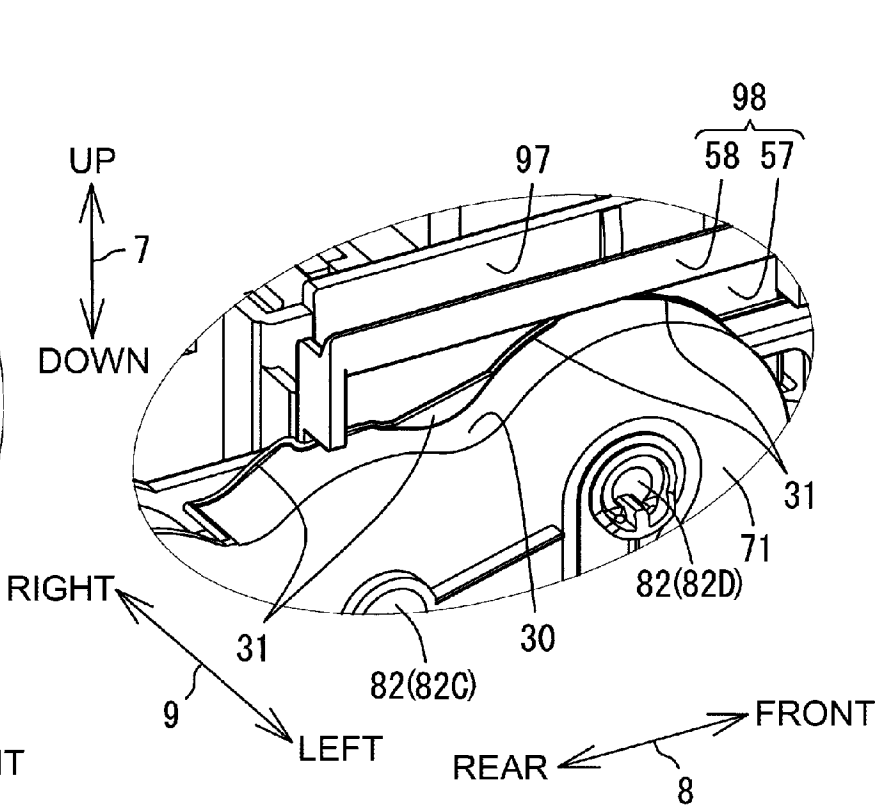
FIG. 8B is an enlarged view depicting a portion indicated with a reference numeral VIIIB in FIG. 7 in the illustrative embodiment according to one or more aspects of the disclosure.
Figure 8A:
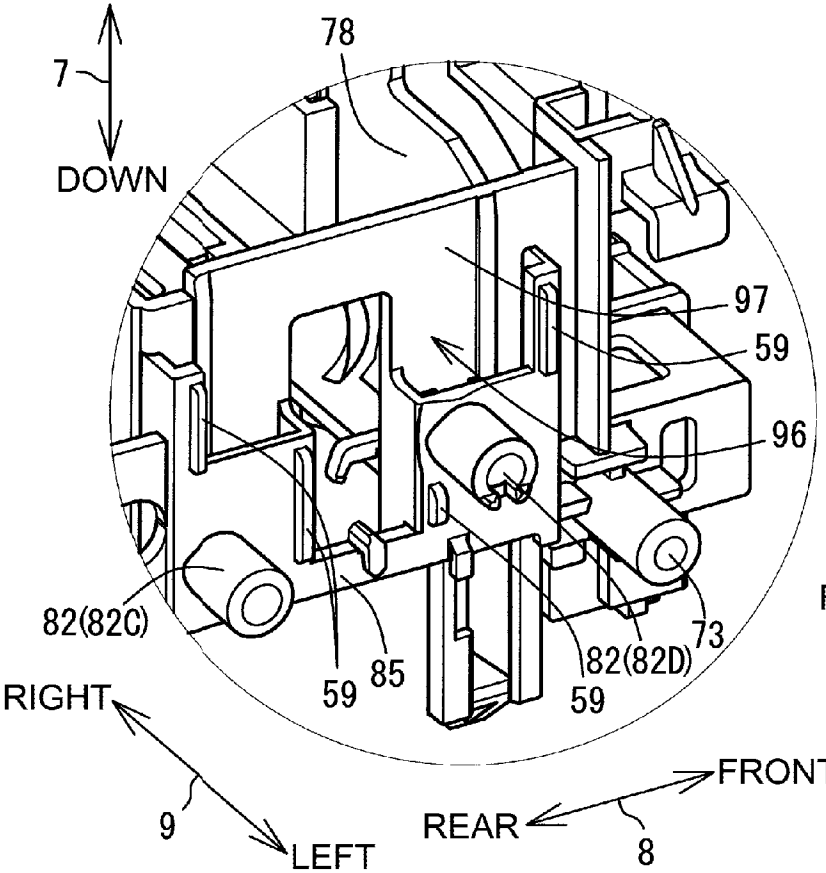
FIG. 8A is an enlarged view depicting a portion indicated with a reference numeral VIIIA in FIG. 5 in the illustrative embodiment according to one or more aspects of the disclosure.

The cover portion 98 may be disposed in contact with the wiper holder 96. As depicted in FIG. 8A, and 10B, projections 59 that may project leftward, that is, toward the cover portion 98, may be disposed on the left surface of the front portion of the left wall portion 81 constituting the wiper holder 96. In the illustrative embodiment, for example, four projections 59 may be disposed. The projections 59 may be spaced apart from each other in the front-rear direction 8 and elongated in the up-down direction 7. With this configuration, the cover portion 98 may be situated in contact with the projections 59 of the wiper holder 96.

No limitation may be put on a number of protrusions 59 disposed, a width of each protrusion 59 in the front-rear direction 8, and a length of each protrusion 59 in the up-down direction 7 as long as the protrusions 59 are disposed to leave a clearance between the left wall portion 81 of the wiper holder 96 and the cover portion 98 while the wiper holder 96 and the cover portion 98 may be in contact with each other, when viewed from above.

Gear Cover 71

As depicted in FIGS. 7, 8B, 10A, and 10B, a gear cover 71 may be disposed on the left of the transmission gears 83 to cover the transmission gears 83. In the illustrative embodiment, the gear cover 71 may be disposed so as to cover the upper, front, rear, and left sides of the gear train of the four transmission gears 83.

The gear cover 71 may comprise a rib 31 that may be disposed in a standing manner on a right edge of an upper surface 30 that may cover the upper side of the transmission gears 83, that is, an edge located closer to the cover portion 98. The rib 31 may extend along the front-rear direction 8 corresponding to the conveyance direction 15 (more specifically, substantially the front-rear direction 8, that is, the rib 31 may be curved along the shape of each of the transmission gears 83). A range in which the rib 31 may extend in the front-rear direction 8 may correspond to a range in which the cover portion 98 may be present at least in the right-left direction 9. As depicted in FIG. 10B, the rib 31 may be disposed at more right position than the one end of the extended portion 58, that is, at a position closer to the other (base) end of the extended portion 58, in the right-left direction 9.

Effects of Illustrative Embodiment

According to the illustrative embodiment, the base unit 72 in which the maintenance unit 66 may be disposed may be made of resin and may have the one-piece structure, and the gear shafts 82 may also be monolithic with the base unit 72. Therefore, this configuration might not require another member for arranging the gear shafts 82 other than the base unit 72. Thus, according to the illustrative embodiment, a space required for installation of the gears 83 and the maintenance unit 66 may be reduced inside the multifunction device 10.

According to the illustrative embodiment, the base unit 72 may be made of resin and may have the one-piece structure. With this configuration, if the inside of each of the gear shafts 82 is filled with the resin, the gear shafts 82 may be deformed. Nevertheless, according to the illustrative embodiment, each of the gear shafts 82 may have a hollow structure, thereby restricting the deformation of the gear shafts 82.

According to the illustrative embodiment, the base unit 72 may be made of resin and may have the one-piece structure. Therefore, there may be a possibility that the connection strength between the gear shaft 82 and the left wall portion 81 may be weak. Nevertheless, according to the illustrative embodiment, in the gear shaft 82, the portion that may be connected with the left wall portion 81 may have the relatively greater diameter. Thus, the connection strength between the gear shaft 82 and the left wall portion 81 may be made stronger.

According to the illustrative embodiment, if the shaft of the sliding gear 75 and the shaft of the transmission gear 83A that may be in engagement with the sliding gear 75 are disposed on different members, respectively, a distance between the shafts may be changed due to deviation of the attachment position of each member, or displacements of the members caused by vibration of the multifunction device 10. Such a deviation or displacements may cause the disengagement between the sliding gear 75 and the transmission gear 83A. Nevertheless, according to the illustrative embodiment, the shaft of the sliding gear 75 and the shaft of the transmission gear 83A that may be in engagement with the sliding gear 75 both may be disposed on the base unit 72. With this configuration, the distance between the shafts might not be changed. As a consequence, an occurrence of the above-described disengagement may be prevented or reduced.

According to the illustrative embodiment, an angle of the feed arm 35 with respect to the recording sheet 12 may be changed depending on the number of recording sheets 12 placed on the feed tray 20. Therefore, a load on the sliding gear 75 by the feed gear 88 via the transmission gear 83 may be changed depending on the angle of the feed arm 35. Further, if the shaft of the sliding gear 75 and the shaft of the transmission gear 83A that may be in engagement with the sliding gear 75 are disposed on different members, respectively, the distance between the shafts may be changed due to the change of the load. Then, the distance change may cause the disengagement between the sliding gear 75 and the transmission gear 83A. Nevertheless, according to the illustrative embodiment, the shaft of the sliding gear 75 and the shaft of the transmission gear 83A that may be in engagement with the sliding gear 75 both may be disposed on the base unit 72. With this configuration, the distance between the shafts might not be changed. As a consequence, an occurrence of the above-described disengagement may be prevented or reduced.

According to the illustrative embodiment, the driving force may be transmitted to the feed rollers 25 when the sliding gear 75 is located at the first position, and the driving force may be transmitted to the maintenance unit 66 when the sliding gear 75 is located at the second position. That is, the feed rollers 25 and the maintenance unit 66 might not be driven simultaneously. Therefore, there may be no risk that the driving of one of the feed rollers 25 and the maintenance unit 66 may influence the driving of the other of the feed rollers 25 and the maintenance unit 66.

According to the illustrative embodiment, the shaft of the maintenance gear 89 and the shafts of the transmission gears 83 may be different members, respectively. Therefore, the rotation of one of the maintenance gear 89 and the gear train of the transmission gears 83 might not influence the rotation of the other of the maintenance gear 89 and the gear train of transmission gears 83.

According to the illustrative embodiment, of the plurality of transmission gears 83, the transmission gear 83A that may be in engagement with the sliding gear 75 that may be movable along the right-left direction 9 may receive a load greater than loads that the transmission gears 83B, 83C, 83D may receive. According to the illustrative embodiment, the third surface 86 disposed between the first surface 84 and the second surface 85, from which the gear shafts 82B, 82C, and 82D may protrude, may increase the strength of the first surface 84, from which the gear shaft 82A supporting the transmission gear 83A may protrude. Therefore, according to the illustrative embodiment, a risk that the portion of the first surface 84 of the left wall portion 81 may be warped due to the large load may be reduced.

According to the illustrative embodiment, the base unit 72 and the conveyor roller 60 may be positioned with respect to the side frames 47. Therefore, a risk of the disengagement between the drive gear 74 disposed on the conveyor roller 60 and the sliding gear 75 disposed on the base unit 72 or an occurrence of unusual noise may be reduced.

According to the illustrative embodiment, the drive gear 74 and the transmission gear 83A that may be in engagement with the sliding gear 75 may be disposed without interference therebetween.

According to the illustrative embodiment, the gear shafts 82 may protrude from the surface of the left wall portion 81, wherein the surface may be opposite to the surface, facing the maintenance unit 66, of the left wall portion 81 in the right-left direction 9. Therefore, while the maintenance unit 66 and the transmission gears 83 supported by the gear shafts 82 may be disposed in the base unit 72, the transmission gears 83 and the maintenance unit 66 may be located separately from each other. Thus, the risk that the driving of one of the gear train of the transmission gears 83 and the maintenance unit 66 may influence the driving of the other of the gear train of the transmission gears 83 and the maintenance unit 66 may be reduced.

According to the illustrative embodiment, the gear shafts 82 may be disposed at the respective different positions in the up-down direction 7. Therefore, loads received by the gear shafts 82 may be spread in the up-down direction 7.

According to the illustrative embodiment, the wiper holder 96 may be monolithic with the base unit 72. Therefore, the strength of the wiper holder 96 may be increased.

According to the illustrative embodiment, the cover portion 98 may be disposed between the wiper 95 and the transmission gears 83. Therefore, a risk that ink scattered by the ink wiping operation on the recording head 38 by the wiper 95 may adhere to the transmission gears 83 may be reduced.

According to the illustrative embodiment, the gear shafts 82 may pass through the cover portion 98. Therefore, the cover portion 98 may be disposed between the wiper 95 and the transmission gears 83 regardless of the presence of the gear shafts 82.

According to the illustrative embodiment, the one end of the extended portion 58 may be located at the higher position than the other (base) end thereof. Therefore, ink that may be scattered by the ink wiping operation on the recording head 38 by the wiper 95 and thus fall onto the upper surface of the extended portion 58 may be likely to fall downward from the other (base) end side but may be hardly to fall downward from the other end side of the extended portion 58. Ink that may fall from the other end side of the extended portion 58 may pass the space between the cover portion 98 and the wiper 95. Thus, there may be less possibility that ink may come into contact with the transmission gears 83. Therefore, according to the illustrative embodiment, ink scattered by the ink wiping operation may hardly adhere to the transmission gears 83.

According to the illustrative embodiment, even when ink that falls onto the upper surface 30 of the gear cover 71 from above runs along the upper surface 30 and thus reaches the end portion of the cover portion 98 side, the rib 31 may prevent ink from falling off from the end portion of the cover portion 98. According to the illustrative embodiment, the rib 31 may be disposed at the position closer to the other (base) end than the one end of the extended portion 58 in the right-left direction 9. Therefore, a risk that ink falling onto the upper surface of the gear cover 71 from above may land between the gear cover 71 and the cover portion 98 may be reduced. With this configuration, a risk that ink may fall down in the clearance between the gear cover 71 and the cover portion 98 to adhere one or more of the gear shafts 82 and the transmission gears 83 located below the gear cover 71 may be reduced.

According to the illustrative embodiment, even when the cover portion 98 is disposed in contact with the wiper holder 96, the clearance may be left between the cover portion 98 and the wiper holder 96 by the projections 59. With this configuration, ink that may be located in the space between the cover portion 98 and the wiper holder 96 may be led downward via the clearance. As a consequence, a risk that ink may adhere to the gear shafts 82 and the transmission gears 83 may be reduced.

What is claimed is:

1. An inkjet recording apparatus comprising:

a recording head configured to record an image onto a recording medium conveyed in a conveyance direction by ejecting ink droplets from nozzles;

a carriage configured to support the recording head and move in a width direction orthogonal to the conveyance direction;

a maintenance unit disposed within a movable range of the carriage and configured to perform maintenance of the recording head in a state where the maintenance unit faces the recording head;

a base unit having a one-piece structure made of resin and including a wall portion, the base unit configured to support the maintenance unit, the base unit further including a plurality of gear shafts integral with and extending from the wall portion in a shaft extending direction such that the plurality of gear shafts do not move independently of the wall portion, and wherein the plurality of gear shafts protrude from the wall portion of the base unit in the width direction:, a plurality of transmission gears disposed on the plurality of gear shafts, respectively, each of the plurality of transmission gears configured to engage at least one other transmission gear of the plurality of transmission gears; and a sliding gear rotatably disposed on the base unit and configured to be movable between a first position and a second position in the width direction, wherein, when the sliding gear is located at the first position, the sliding gear engages one transmission gear of the plurality of transmission gears, and when the sliding gear is located at the second position, the sliding gear does not engage any of the plurality of transmission gears, wherein the sliding gear moves from the first position to the second position in a sliding direction opposite to the shaft extending direction.

2. The inkjet recording apparatus to claim 1, wherein at least one gear shaft of the plurality of gear shafts has a hollow structure.

3. The inkjet recording apparatus according to claim 1, wherein each of the plurality of gear shafts comprises a shaft portion and an interconnection portion, wherein one end of the interconnection portion is connected with the shaft portion, and another end of the interconnection portion is connected with the wall portion, and wherein the interconnection portion is larger in size than the shaft portion.

4. The inkjet recording apparatus according to claim 1, further comprising:

a tray configured to support a recording medium;

a feed roller configured to feed the recording medium supported by the tray;

an arm configured to support the feed roller rotatably;

a shaft portion rotatably disposed at a position different from the feed roller in the arm and configured to support the arm swingably; and a power transmission portion disposed in the arm and configured to transmit a rotational driving force of the shaft portion to the feed roller;

wherein the base unit further comprises a shaft support portion integral with the wall portion and is configured to support the shaft portion rotatably; and wherein the shaft portion further comprises a feed gear configured to engage another transmission gear of the plurality of transmission gears in a state where the shaft portion is supported by the shaft support portion.

5. The inkjet recording apparatus according to claim 1, wherein the maintenance unit is disposed on a first side of the wall portion of the base unit in the width direction and the plurality of transmission gears are disposed on a second side of the wall portion opposite to the first side of the wall portion in the width direction, and wherein the inkjet recording apparatus further comprises:

a maintenance gear rotatably supported by the base unit and configured to drive the maintenance unit by its rotation, wherein the maintenance gear is disposed on the first side of the wall portion, and wherein the sliding gear is configured to engage the maintenance gear when the sliding gear is located at the second position.

6. The inkjet recording apparatus according to claim 5, wherein the base unit further comprises another gear shaft that is disposed integrally therewith and at a position different from one gear shaft of the plurality of gear shafts, the another gear shaft being disposed on the first side of the wall portion opposite to the second side of the wall portion, and wherein the maintenance gear is supported by the another gear shaft.

7. The inkjet recording apparatus according to claim 1, wherein the wall portion comprises a first surface, a second surface, and a third surface, wherein the second surface is located at a position different from the first surface with respect to the width direction, wherein the third surface connects the first surface and the second surface, wherein one gear shaft of the plurality of gear shafts protrudes from the first surface, and wherein the one gear shaft of the plurality of gear shafts supports one transmission gear, which is configured to engage the sliding gear, of the plurality of transmission gears, and wherein another gear shaft of the plurality of gear shafts protrudes from the second surface, and wherein the another gear shaft of the plurality of gear shafts supports another transmission gear, which does not engage the sliding gear, of the plurality of transmission gears.

8. The inkjet recording apparatus according to claim 1, further comprising:

a conveyor roller configured to rotate to convey the recording medium;

a carriage frame configured to support the carriage movably in the width direction;

a side frame configured to support the carriage frame and support the conveyor roller rotatably; and a drive gear disposed on the conveyor roller and configured to engage the sliding gear, wherein the base unit is disposed on the carriage frame.

9. The inkjet recording apparatus according to claim 1, further comprising a drive gear configured to engage the sliding gear and rotate by application of a driving force from a drive source, wherein one gear shaft of the plurality of gear shafts and a shaft of the drive gear are disposed on opposite sides of the sliding gear with respect to the conveyance direction, and wherein the one gear shaft of the plurality of gear shafts is configured to support one transmission gear, which is configured to engage the sliding gear, of the plurality of transmission gears.

10. The inkjet recording apparatus according to claim 1, wherein the base unit has an opening on one side opposing the recording head, wherein the maintenance unit is disposed in the opening, and wherein the plurality of gear shafts protrude from one surface of the wall portion, wherein the one surface is opposite to another surface, facing the maintenance unit, of the wall portion with respect to the width direction.

11. The inkjet recording apparatus according to claim 1, wherein the plurality of gear shafts are located at respective different positions from each other with respect to a direction orthogonal to the conveyance direction and the width direction.

12. The inkjet recording apparatus according to claim 1, further comprising a wiper configured to contact a nozzle surface of the recording head and wipe off ink adhered to the nozzle surface, wherein the base unit further comprises a wiper holder configured to hold the wiper, and wherein at least one gear shaft of the plurality of gear shafts is disposed on a wall surface of the wiper holder.

13. The inkjet recording apparatus according to claim 12, further comprising a cover portion disposed between, in the width direction, the wiper and a transmission gear, of the plurality of transmission gears, that is disposed on the at least one gear shaft of the plurality of gear shafts, and configured to cover, in a direction perpendicular to the conveyance direction and the width direction, a portion of the transmission gear to prevent ink adhesion to the transmission gear due to scattering of ink by a wiping operation of the wiper.

14. The inkjet recording apparatus according to claim 13, wherein the cover portion is supported by the at least one gear shaft of the plurality of gear shafts.

15. The inkjet recording apparatus according to claim 13, wherein the cover portion comprises an upright portion disposed in a standing manner to protrude above the transmission gear, and an extended portion extending toward the transmission gear from an upper end of the upright portion in the width direction, wherein a top end of the extended portion is located at a higher position than a base end of the extended portion.

16. The inkjet recording apparatus according to claim 15, further comprising a gear cover configured to cover an upper side of the transmission gear, wherein the gear cover comprises a rib protruding upward from an upper surface of the gear cover and extending along the conveying direction, and wherein the rib is located at a position that is closer to the base end of the extended portion than the top end of the extended portion with respect to the width direction.

17. The inkjet recording apparatus according to claim 13, wherein the wiper holder comprises a projection disposed on the wall surface of the wiper holder that is disposed on the at least one gear shaft of the plurality of gear shafts, and wherein the projection projects toward the cover portion.

18. The inkjet recording apparatus according to claim 1, wherein the wall portion and the gear shafts are formed at a same time as formation of the base unit and integrally molded, and wherein the plurality of gear shafts include at least three gear shafts.

19. The inkjet recording apparatus according to claim 1, wherein the base unit is formed in a mold with portions for receiving resin for the wall portion and the plurality of gear shafts.

20. An inkjet recording apparatus comprising:

a recording head configured to record an image onto a recording medium conveyed in a conveyance direction by ejecting ink droplets from nozzles;

a carriage configured to support the recording head and move in a width direction orthogonal to the conveyance direction through a movable range;

a maintenance unit disposed within the movable range of the carriage, the maintenance unit being configured to perform maintenance of the recording head at a state where the maintenance unit faces the recording head; and a base unit configured to support the maintenance unit, the base unit including a wall portion supporting a plurality of gear shafts protruding in the width direction from the wall portion, wherein the plurality of gear shafts are not movable relative to the wall portion a plurality of transmission gears disposed on the plurality of gear shafts, respectively, and each of the plurality of transmission gears being configured to engage at least one other transmission gear of the plurality of transmission gears; and a slidable gear rotatably disposed on the base unit and configured to be movable between a first position and a second position along the width direction, wherein, when the sliding gear is located at the first position, the slidable gear engages one transmission gear of the plurality of transmission gears, and when the slidable gear is located at the second position, the slidable gear does not engage any of the plurality of transmission gears, wherein the slidable gear moves from the first position to the second position in a sliding direction opposite to the shaft extending direction.

21. The inkjet recording apparatus according to claim 20, wherein the plurality of gear shafts are rigidly supported by the wall portion.

22. The inkjet recording apparatus according to claim 20, wherein the wall portion includes at least one surface with the plurality of gear shafts being disposed on the at least one surface.

23. The inkjet recording apparatus according to claim 20, wherein the wall portion includes at least two surfaces with at least one of the plurality of gear shafts being disposed on a first of the at least two surfaces and another of the plurality of gear shafts being disposed on a second of the at least two surfaces.

24. The inkjet recording apparatus according to claim 20, wherein the slidable gear, at the second position, is configured to connect to a gear, different from the plurality of transmission gears, configured to power to the maintenance unit.

25. The inkjet recording apparatus according to claim 20, wherein the wall portion includes at least two surfaces with a first of the at least two surfaces supporting at least one of the plurality of gear shafts, wherein the base unit includes a slidable gear that is configured to slide between positions, the slidable gear configured to slide on a slidable gear shaft, wherein a second of the at least two surfaces of the wall portion supports the slidable gear shaft.

26. The inkjet recording apparatus according to claim 25, wherein the gear shaft supported by the first of the two surfaces of the wall portion supports a first transmission gear, and wherein, at a first position of the slidable gear, the slidable gear meshes with the first transmission gear.

27. The inkjet recording apparatus according to claim 20, wherein the base unit further comprises:

another wall portion positioned to contact the maintenance unit when supported by the base unit, the another wall portion contacting and being arranged perpendicular to the wall portion supporting the plurality of gear shafts.

* * * * *